US008884527B2

(12) United States Patent
Lin et al.

(10) Patent No.: US 8,884,527 B2
(45) Date of Patent: Nov. 11, 2014

(54) LAMPS

(71) Applicant: Lextar Electronics Corporation, Hsinchu (TW)

(72) Inventors: Feng-Ling Lin, Pingtung (TW); Po-Shen Chen, New Taipei (TW); Hui-Ying Chen, Hemei Township (TW); Chun-Kuang Chen, Taipei (TW); Tung-Yu Chen, Tainan (TW)

(73) Assignee: Lextar Electronics Corporation, Hsinchu (TW)

( * ) Notice: Subject to any disclaimer, the term of this patent is extended or adjusted under 35 U.S.C. 154(b) by 102 days.

(21) Appl. No.: 13/653,015

(22) Filed: Oct. 16, 2012

(65) Prior Publication Data

US 2013/0093331 A1 Apr. 18, 2013

(30) Foreign Application Priority Data

Oct. 17, 2011 (TW) ..... 100137473 A

(51) Int. Cl.
*H05B 37/02* (2006.01)

(52) U.S. Cl.
USPC ..... 315/149; 315/291

(58) Field of Classification Search
USPC ..... 315/149–152, 291, 294, 297, 307
See application file for complete search history.

(56) References Cited

U.S. PATENT DOCUMENTS

| | | | | |
|---|---|---|---|---|
| 6,132,072 | A | 10/2000 | Turnbull et al. | |
| 7,515,128 | B2 * | 4/2009 | Dowling | 345/83 |
| 2006/0104058 | A1 | 5/2006 | Chemel et al. | |
| 2006/0149607 | A1 * | 7/2006 | Sayers et al. | 705/7 |
| 2008/0170387 | A1 | 7/2008 | Fluss et al. | |
| 2010/0188022 | A1 * | 7/2010 | Gerlach et al. | 315/312 |
| 2010/0277097 | A1 * | 11/2010 | Maxik | 315/294 |

FOREIGN PATENT DOCUMENTS

WO WO 2008/044171 A2 4/2008

* cited by examiner

*Primary Examiner* — Jason M Crawford
(74) *Attorney, Agent, or Firm* — Moser Taboada

(57) ABSTRACT

An embodiment of the invention provides a lamp comprising a control circuit and a light emitting device. The light emitting device comprises a plurality of light emitting units with different wavelengths. The control circuit calibrates a control signal according to an environment light to adjust a light spectrum of the light emitting device by controlling the luminance of each light emitting unit.

15 Claims, 5 Drawing Sheets

LAMPS

RELATED APPLICATIONS

This application claims priority to Taiwan Application Serial Number 100137473, filed Oct. 17, 2011, which is herein incorporated by reference.

BACKGROUND

1. Field of Invention

The invention relates to a lamp. More particularly, the invention relates to a lamp capable of adjusting color temperature along with an environment light and the brightness vision of human eyes.

2. Description of Related Art

Light emitting diodes (LEDs) which are used in electronic components in the past are now widely used in lighting products. Since the LEDs have excellent electrical property and structural characteristics, the demand on the LEDs is gradually increased. Compared with fluorescence lamps and incandescent lamps, great attention has been paid to white LEDs. However, in accordance with different demands of users, lamps capable of meeting the demand for generating lights with difference color temperatures are created. However the color temperature of conventional LEDs is determined when the LEDs leave the factory and the color temperature cannot be changed ever since, and users can only change the LEDs with different color temperatures to obtain lights with different color temperatures when needed, which is inconvenient for the users.

SUMMARY

An aspect of the invention provides a lamp capable of adjusting light spectrum.

Another aspect of the invention provides a lamp capable of adjusting color temperature along with an environment light and the brightness vision of human eyes.

Other aspects and advantages of the invention can be further understood from technical characteristics disclosed by the invention.

In order to achieve one or part or all of the above aspects or other aspects, an embodiment of the invention provides a lamp including a light emitting device and a control circuit. The light emitting device includes a plurality of light emitting units with different wavelengths. The control circuit calibrates a control signal according to an environment light to adjust a light spectrum of the lamp by controlling the luminance of each light emitting unit.

Another embodiment of the invention provides a lamp including a light emitting device and a control circuit. The light emitting device includes a green light emitting unit, a cyan light emitting unit and a red light emitting unit. The control circuit adjusts the luminance of the green light emitting unit, the cyan light emitting unit and the red light emitting unit according to an environment light signal. When a luminance of the environment light is increased, the control circuit reduces a first luminance of the cyan light emitting unit and increases a second luminance of the green light emitting unit, and when the luminance of the environment light is reduced, the control circuit increases the first luminance of the cyan light emitting unit and reduces the second luminance of the green light emitting unit.

DETAILED DESCRIPTION

The above and other technical contents, features and functions of the invention will be clearly presented in the detailed description of an optimal embodiment in accordance with reference drawings. Direction words referred to in the following embodiments, such as above, below, left, right, front or back, are only directions of the referential accompanying drawings. Therefore, the direction words are used for illustrating instead of limiting the invention.

Figure 1:
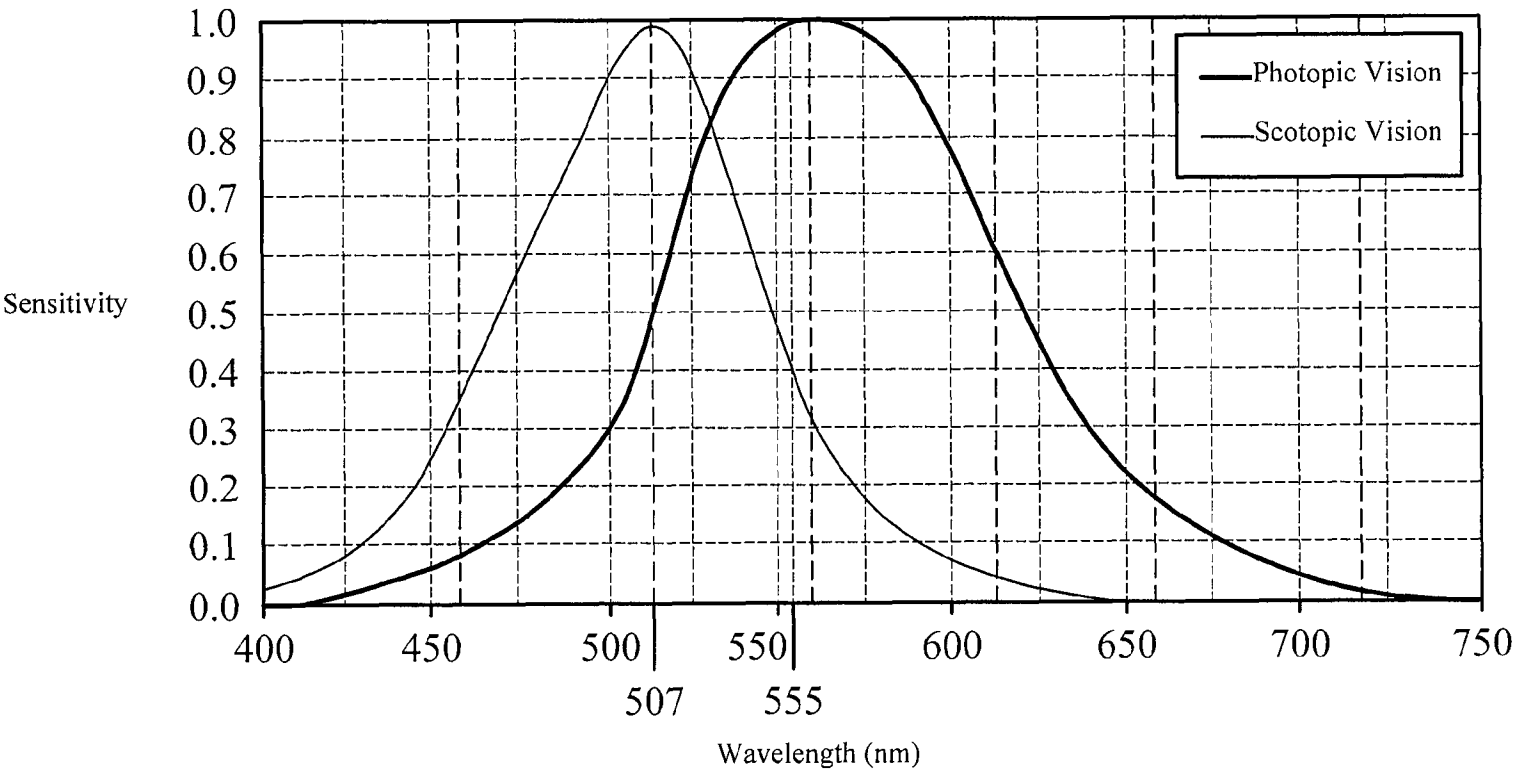
FIG. 1 illustrates a spectral luminous efficiency diagram of human eyes.

FIG. 1 illustrates a spectral luminous efficiency diagram of human eyes. It can be seen from the diagram that the peak of a photopic vision curve of the human eyes approximately falls at the position of the wavelength of 507 nm, while the peak of a scotopic vision curve of the human eyes approximately falls at the position of the wavelength of 555 nm. However, actually, the peak of the photopic vision curve approximately falls at the position of wavelengths from 450 nm to 530 nm, while the peak of the scotopic vision curve approximately falls at the position of the wavelengths from 530 nm to 590 nm. When the environment light changes rapidly, for example changing from bright to dark or from dark to bright, the human eyes needs a period of time to adapt to the change. Therefore, for the light source regulation mechanism of the lamp, the photopic vision curve and the scotopic vision curve of the human eyes should be considered, so that the light source regulation mechanism of the lamp changes the light emitting spectrum of the overall lamp preferentially, and the lighting spectrum of the lamp is consistent with spectral luminous efficiency curves of the brightness vision of the human eyes, instead of just adjusting color temperature or luminance.

Figure 2:
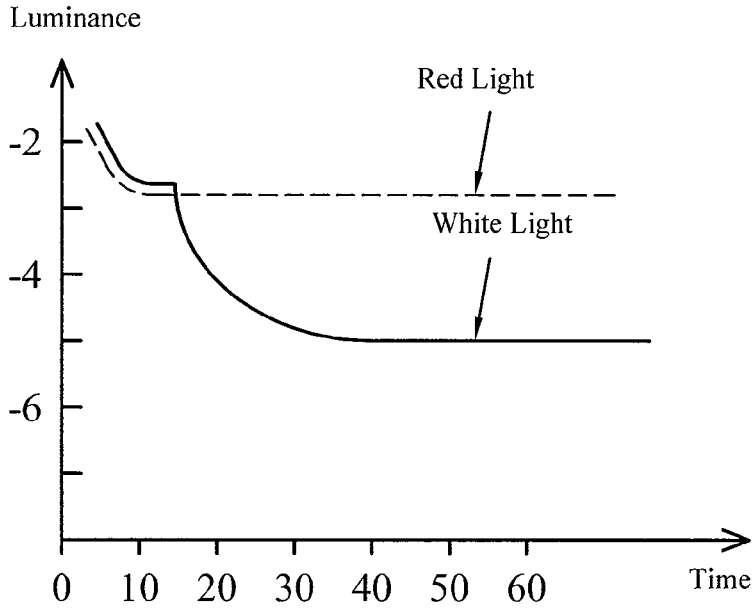
FIG. 2 illustrates a light adaption curve of human eyes.

FIG. 2 illustrates a light adaption curve of human eyes. Generally, when the light is switched from a high luminance to a low luminance, the human eyes adapt to the change after ten minutes usually. However, it can be seen from the curve that for red light, the light adaption situation of the human eyes is relatively steady, and thus according to the phenomenon, in the period that a light source is switched from the high luminance to the low luminance, the following two switching manners can be utilized:

(1) during switching, a red light spectrum is enhanced gradually and simultaneously the intensity of other color light is weakened, and after ten minutes, the intensity of other color light is enhanced gradually and the intensity of the red light is weakened gradually; and (2) during switching, according to the current light spectrum of the light source, the light spectrum of the whole light source is adjusted gradually, making the peak of the light spectrum of the light source gradually move towards the position of the wavelength of 507 nm.

Figure 3:
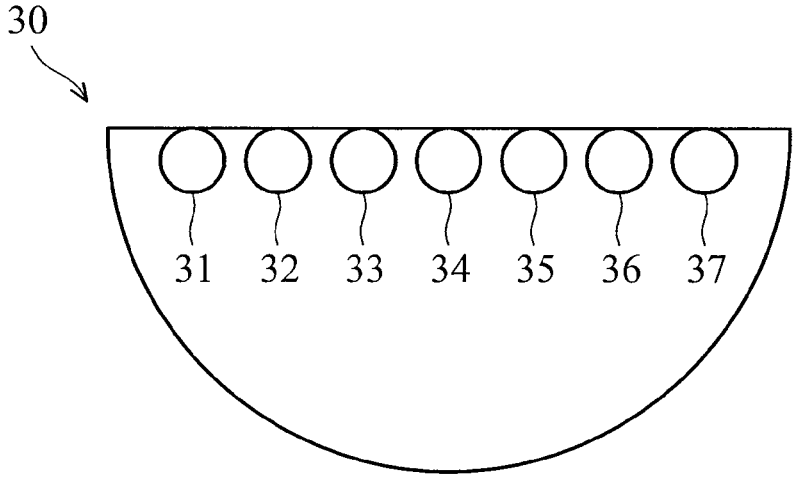
FIG. 3 illustrates a schematic view of the lamp.

In view of the above, the invention provides a lamp capable of adjusting the light spectrum along with the environment light and the brightness vision of the human eyes, and the lamp includes a plurality of light emitting devices with different colors. Referring to FIG. 3, it illustrates a schematic view of a lamp. The lamp 30 includes a red light emitting unit 31, a red-orange light emitting unit 32, a yellow light emitting unit 33, a green light emitting unit 34, a cyan emitting unit 35, a blue light emitting unit 36 and a royal blue light emitting unit 37. The lamp 30 is controlled by a control circuit (not shown), and the control circuit can adjust the luminance of each light emitting device independently, so as to further achieve the purpose of adjusting the light emitting spectrum of the lamp 30.

Figure 4:
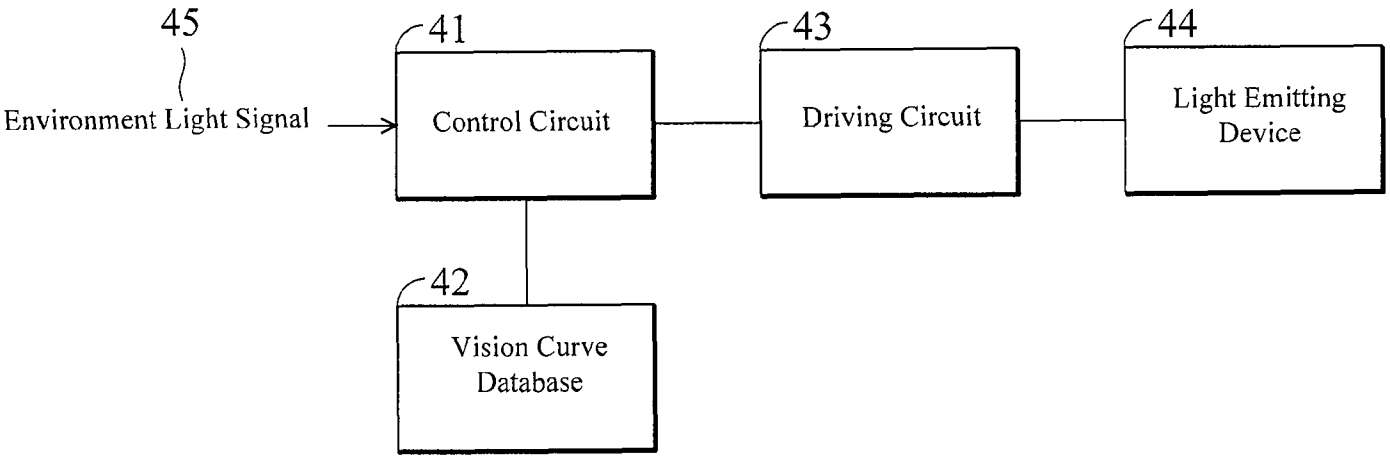
FIG. 4 illustrates a schematic view of an embodiment of the lamp of the invention.

FIG. 4 illustrates a schematic view of an embodiment of the lamp of the invention. The lamp includes a control circuit 41, a vision curve database 42, a driving circuit 43 and a light emitting device 44. The light emitting device 44 includes a plurality of different light emitting units (as shown in FIG. 3) with different wavelengths; for example, the emitting units may be LEDs or the like. The control circuit 41 receives an environment light signal 45 related to environment light to determine the change mode of the light at this time and selects a corresponding vision curve from the vision curve database 42. For example, when the control circuit 41 determines that the light is switched from a high luminance to a low luminance at this time according to the environment light signal 45, the control circuit 41 selects a scotopic vision curve from the vision curve database 42. When the control circuit 41 determines that the light is switched from the low luminance to the high luminance at this time according to the environment light signal 45, the control circuit 41 selects a photopic vision curve from the vision curve database 42. In this embodiment, a user can independently define different vision curves to be used by the control circuit 41. For example, the user can set a first vision curve to be specially used when the user watches movies.

The driving circuit 43 is controlled by a control signal transmitted by the control circuit 41 and outputs a plurality of driving signals to the corresponding plurality of light emitting units in the light emitting device 44. The driving circuit 43 can adjust the current transmitted to each light emitting unit or the duty cycle of a pulse width adjusting signal according to the control signal and thus adjust the luminance of each light emitting unit independently, so as to further achieve the purpose of changing the light emitting spectrum of the light emitting device 44. The control circuit 41 calibrates the control signal transmitted to the driving circuit 43 according to the vision curve selected from the vision curve database 42. For example, when the control circuit 41 detects that the luminance of the environment light is increased, the control circuit 41 selects a first light emitting unit from these light emitting units according to the wavelength range of a peak value of the photopic vision curve and increases the luminance of the first light emitting unit and the luminance of other light emitting units, wherein the luminance variation of the first light emitting unit is greater than that of other light emitting units. It can be seen from the spectral luminous efficiency diagram of FIG. 1 that the wavelength range of the peak value of the photopic vision curve is about 530 nm to 590 nm, and this wavelength range is close to the light emitting wavelength range of the green light diode, so that the control circuit can calibrate the control signal, so as to increase the luminance of the light emitting units of the light emitting device 44 and make the luminance increment of the green light emitting unit of the light emitting device 44 be greater than the luminance increment of other light emitting units. Subsequently, after a period of time, the control circuit 41 calibrates the control signal again, so as to make the luminance increment of the green light emitting unit of the light emitting device 44 be reduced to be equal to the luminance increment of other light emitting units.

When the control circuit 41 detects that the luminance of the environment light is reduced, the control circuit 41 selects a second light emitting unit from these light emitting units according to the wavelength range of a peak value of the scotopic vision curve, increases the luminance of the second light emitting unit and gradually reduces the luminance of other light emitting units.

In this embodiment, the second light emitting unit is a red light diode. Subsequently, after a period of time, the control circuit 41 calibrates the control signal again, so as to adjust the luminance variation of the red light diode to be equal to the luminance variation of other light emitting units. For example, the original luminance of other light emitting units in the light emitting module is reduced by 20%, while the luminance of the red light diode is increased by 30% initially, and after a period of time, the control circuit 41 calibrates the control signal so as to reduce the luminance of the red light diode to be 80% of the original luminance.

The control circuit 41 quickly increases the luminance of the light emitting unit with a red spectrum of the light emitting device at the beginning.

When the second light emitting unit complies with the scotopic vision curve, a luminance increment of the red spectrum in the light emitting device 44 is removed.

The range of the red spectrum is between 600 nm and 680 nm.

The control circuit controls 41 the luminance of the light emitting units, as shown in FIG. 3, by adjusting the current value of a plurality of currents outputted to the light emitting units.

The control circuit 41 controls the luminance of the light emitting units by adjusting a plurality of duty cycles for outputting a plurality of driving signals of the light emitting units.

The light emitting device 44 comprises the green light emitting unit 34, the cyan light emitting unit 35 and the red light emitting unit 31, as shown in FIG. 3. The control circuit 41 adjusts the luminance of the green light emitting unit 34, the cyan light emitting unit 35 and the red light emitting unit 31 according to an environment light signal related to environment light. When a luminance of the environment light is increased, the control circuit 41 reduces a first luminance of the cyan light emitting unit 35 and increases a second luminance of the green light emitting unit 34. When the luminance of the environment light is reduced, the controls circuit 41 increases the first luminance of the cyan light emitting unit 35 and reduces the second luminance of the green light emitting unit 34.

When the luminance of the environment light is reduced, the control circuit 41 gradually increases a third luminance of the red light emitting unit 31 and then reduces the third of the red light emitting unit 31 to an initial luminance after the first luminance of the cyan light emitting unit complies with a scotopic vision curve.

The initial luminance refers to the luminance before adjustment of the red light emitting unit 31.

In this embodiment, light emitting units each corresponding to the wavelength ranges of the peak values of the photopic vision curve and the scotopic curve can all be found in the light emitting device 44. However, if no corresponding light emitting unit is found in the light emitting device 44, the control circuit 41 can select a light emitting unit having the closest wavelength range to adjust. For example, if the green light emitting unit is not included in the light emitting device 44, the control circuit 41 can select a cyan diode to regulate; and if the red light diode is not included in the light emitting device 44, the control circuit 41 can select the red-orange diode to regulate. In another embodiment, the control circuit 41 can select two or more light emitting units to regulate according to the wavelength range of the peak value of the vision curve.

Figure 5:
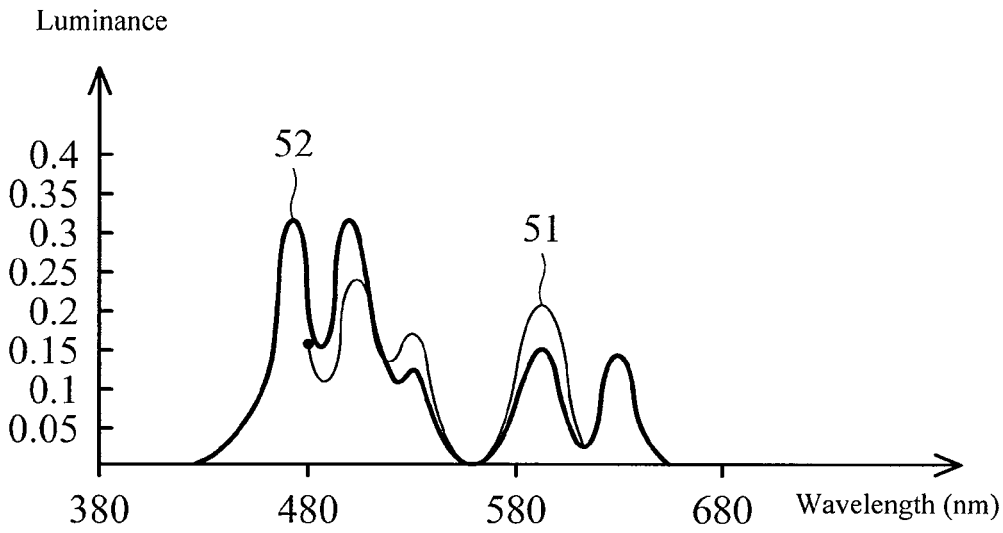
FIG. 5 illustrates a schematic adjusting view of the light emitting spectrum of the lamp.

Referring to FIG. 5, it illustrates a schematic adjusting view of the light emitting spectrum of the lamp. Light spectrum 51 is the initial light spectrum of the lamp. The lamp includes a blue light diode, a green light diode, a red light diode, a cyan light diode and a yellow light diode therein. When the control circuit of the lamp detects that the luminance of the environment light at this time is reduced, the control circuit gradually increases the light emitting luminance of the cyan light diode, so that the light spectrum has a high strength at the wavelength of 500 nm; and the control circuit reduces the light emitting luminance of the green light diode and the light emitting luminance of the yellow light diode, so as to comply with the scotopic vision curve. Otherwise, if the control circuit detects that the luminance of the environment light at this time is increased, the control circuit reduces the light emitting luminance of the cyan light diode and gradually increases the light emitting luminance of the green light diode.

Figure 6:
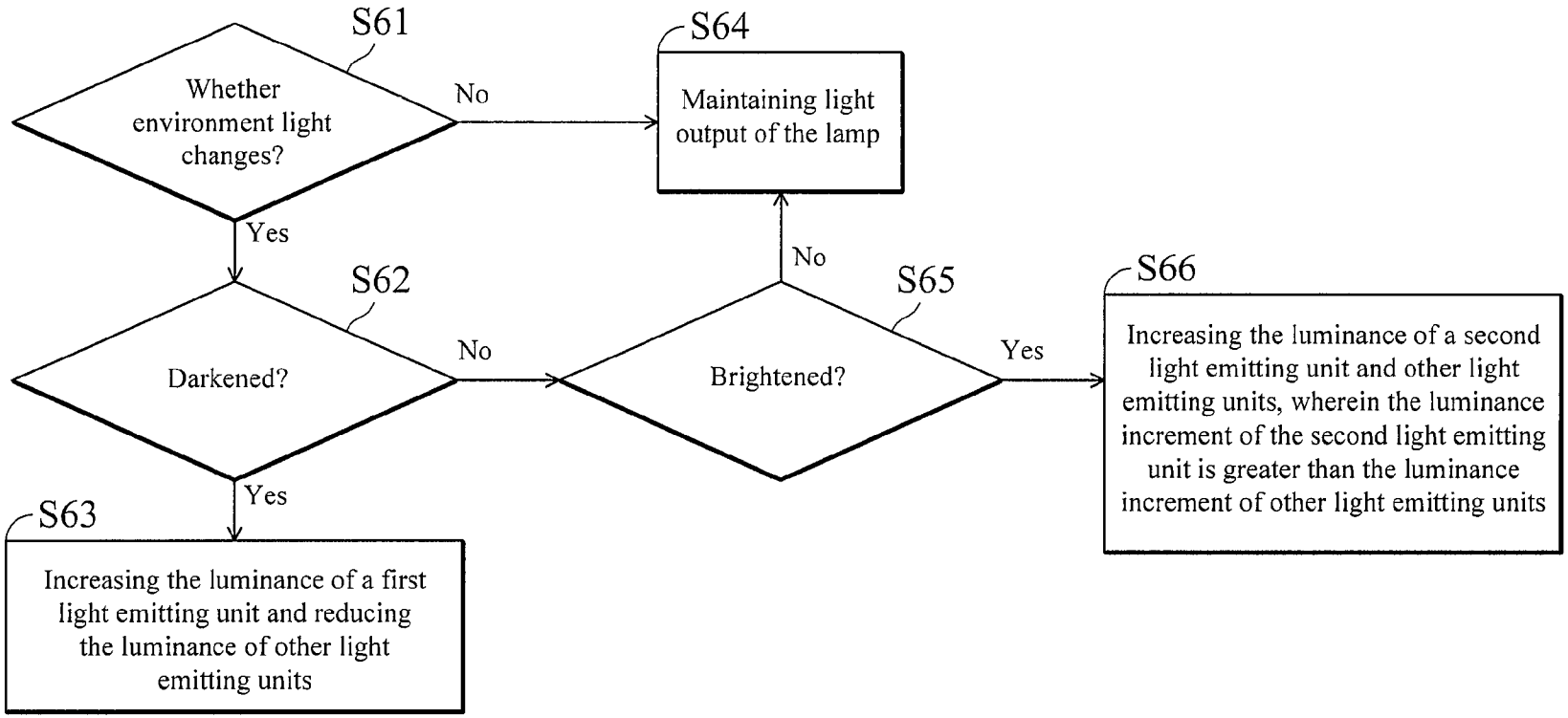
FIG. 6 illustrates a flow chart of an embodiment of a method for controlling the lamp of the invention.

FIG. 6 illustrates a flow chart of an embodiment of a method for controlling the lamp of the invention. In step S61, the control circuit in the lamp determines whether the luminance of the environment light changes and detects the change of the environment light via an optical detector. In step S62, the control circuit firstly determines whether the environment light is darkened at this time, and if so, step S63 is executed. In step S63, the control circuit firstly selects a wavelength range according to a scotopic vision curve and then selects a first light emitting unit from the lamp according to the wavelength range; subsequently, the control circuit increases the luminance of the first light emitting unit and reduces the luminance of other light emitting units; and after a period of preset time (e.g., ten minutes), the luminance of the first light emitting unit is reduced, so as to make the luminance variation of the first light emitting unit be the same as that of other light emitting units. In step S64, the control circuit maintains the light output of the lamp at this time. In step S65, the control circuit determines whether the environment light is brightened or not at this time, and if not, step S64 is executed, and if so, step S66 is executed. In step S66, the control circuit selects a wavelength range according to a photopic vision curve and selects a second light emitting unit according to the wavelength range. Subsequently, the control unit increases the luminance of the second light emitting unit and the luminance of other light emitting units, wherein the luminance increment of the second light emitting unit is greater than that of other light emitting units. Then, after a period of preset time, the luminance of the second light emitting unit is reduced, so as to make the luminance increment of the second light emitting unit be equal to that of other light emitting units.

Although embodiments of the invention are described in the foregoing, they are not intended to limit the invention. That is, simply equivalent variations and modifications made in accordance with the claims and the description of the invention shall fall within the scope of the invention. In addition, it is not necessary for any embodiment or claim of the invention to achieve all aspects, advantages or features disclosed by the invention. Moreover, the abstract and the title are only used for assisting patent file retrieval, without limiting the patent right scope of the invention.

What is claimed is:

1. A lamp, comprising:

a light emitting device which comprises a plurality of light emitting units with different wavelengths; and a control circuit which calibrates a control signal according to an environment light, to adjust a light spectrum of the light emitting device by controlling the luminance of each light emitting unit, wherein the control circuit further calibrates the control signal according to a photopic vision curve and a scotopic vision curve, wherein when the luminance of the environment light is reduced, the control circuit selects a second light emitting unit from the light emitting units according to a wavelength range and increases the luminance of the second light emitting unit and gradually reduces the luminance of the light emitting units except the second light emitting unit.

2. The lamp of claim 1, wherein the wavelength range is determined according to the scotopic vision curve.

3. The lamp of claim 2, wherein the wavelength range is between 450 nm and 530 nm.

4. The lamp of claim 3, wherein the center wavelength of the scotopic vision curve is 507 nm.

5. The lamp of claim 2, wherein when the second light emitting unit complies with the scotopic vision curve, a luminance increment of the red spectrum in the light emitting device is removed.

6. The lamp of claim 1, wherein the control circuit quickly increases the luminance of the light emitting unit with a red spectrum of the light emitting device at the beginning.

7. The lamp of claim 6, wherein the range of the red spectrum is between 600 nm and 680 nm.

8. The lamp of claim 1, wherein the control circuit controls the luminance of the light emitting units by adjusting the current value of a plurality of currents outputted to the light emitting units.

9. The lamp of claim 1, wherein the control circuit controls the luminance of the light emitting units by adjusting a plurality of duty cycles for outputting a plurality of driving signals of the light emitting units.

10. A lamp, comprising:

a light emitting device which comprises a green light emitting unit, a cyan light emitting unit and a red light emitting unit; and a control circuit which adjusts the luminance of the green light emitting unit, the cyan light emitting unit and the red light emitting unit according to an environment light signal related to environment light, wherein when a luminance of the environment light is increased, the control circuit reduces a first luminance of the cyan light emitting unit and increases a second luminance of the green light emitting unit, and when the luminance of the environment light is reduced, the controls circuit increases the first luminance of the cyan light emitting unit and reduces the second luminance of the green light emitting unit, wherein when the luminance of the environment light is reduced, the control circuit gradually increases a third luminance of the red light emitting unit and then reduces the third of the red light emitting unit to an initial luminance after the first luminance of the cyan light emitting unit complies with a scotopic vision curve.

11. The lamp of claim 10, wherein the initial luminance refers to the luminance before adjustment of the red light emitting unit.

12. A lamp, comprising:

a light emitting device which comprises a plurality of light emitting units with different wavelengths; and a control circuit which calibrates a control signal according to an environment light, to adjust a light spectrum of the light emitting device by controlling the luminance of each light emitting unit, wherein the control circuit further calibrates the control signal according to a photopic vision curve and a scotopic vision curve, wherein when a luminance of the environment light is increased, the control circuit selects a green light emitting unit from the light emitting units according to a wavelength range and increases the luminance of the green light emitting unit and the luminance of other light emitting units, wherein the luminance variation of the green light emitting unit is greater than the luminance variation of the other light emitting units.

13. The lamp of claim 12, wherein the wavelength range is determined according to the photopic vision curve.

14. The lamp of claim 13, wherein the wavelength range is between 530 nm and 590 nm.

15. The lamp of claim 14, wherein a center wavelength of the photopic vision curve is 555 nm.

* * * * *